United States Patent [19]

Keen

[11] 4,388,723

[45] Jun. 14, 1983

[54] CONTROL DEVICE FOR STEERABLE NULL ANTENNA PROCESSOR

[75] Inventor: James Keen, Belford, N.J.

[73] Assignee: The United States of America as represented by the Secretary of the Army, Washington, D.C.

[21] Appl. No.: 279,397

[22] Filed: Jul. 1, 1981

[51] Int. Cl.[3] ..... H04K 3/00

[52] U.S. Cl. ..... 375/1; 375/115; 343/18 E

[58] Field of Search ..... 375/1, 2, 115; 455/26, 455/278, 296, 305; 343/5 PN, 18 E, 100 SA

[56] References Cited

U.S. PATENT DOCUMENTS

| | | | |
|---|---|---|---|
| 3,725,929 | 4/1973 | Spanos | 343/100 SA |
| 4,152,702 | 5/1979 | Piesinger | 375/1 |
| 4,214,244 | 7/1980 | McKay et al. | 343/100 SA |
| 4,255,791 | 3/1981 | Martin | 375/1 |
| 4,291,410 | 9/1981 | Caples et al. | 375/1 |
| 4,309,769 | 1/1982 | Taylor, Jr. | 375/1 |
| 4,320,514 | 3/1982 | Haskell | 371/1 |

*Primary Examiner*—Benedict V. Safourek
*Assistant Examiner*—Stephen Chin
*Attorney, Agent, or Firm*—Robert P. Gibson; Jeremiah G. Murray; Anthony T. Lane

[57] ABSTRACT

A radio receiving system partially overcomes jamming and other interference by receiving on a narrow selected frequency which is rapidly changed, i.e., fast frequency hopping (FFH). The system includes a broadband receiving antenna array and a steerable null antenna processor which creates an antenna null pattern. A control device connected to the (FFH) radio connects a portion of the intermediate frequency (IF) of the radio to a bank of three narrowband IF filters in the control device. The output of the first IF filter, at the IF frequency, provides the signal (S) level and the outputs of the second and third filters, which are offset from the IF frequency, are summed to provide the interference (I) level; the I and S levels being used to control the antenna processor.

10 Claims, 2 Drawing Figures

CONTROL DEVICE FOR STEERABLE NULL ANTENNA PROCESSOR

The invention described herein may be manufactured and used by or for the Government for Governmental purposes without the payment of any royalties thereon or therefor.

BACKGROUND OF THE INVENTION

The system of the present invention relates to radio communication systems and more particularly to a radio receiver and antenna system which is useful as an electronic counter-counter (ECCM) system.

At the present time, radio communication in a military situation is part of electronic warfare (EW) in which the enemy, or potential enemy, attempts to intercept messages or to prevent the transmission of messages. One widely used method of preventing transmission by radio is to "jam", i.e., disturb the radio communication between a radio transmitter and a radio receiver. Such radio jamming may either be broad band (a wide portion of the radio spectrum) or narrow band (a narrow portion of the radio spectrum).

One broad band method that may be used to jam radio transmission is to produce noise over the entire frequency spectrum that might be used by the radio transmitter. For example, one may modulate the RF signal with a noise source over the range from 30 to 80 MHz, the range most likely used for radio transmission. Such broad band jamming may require a large transmitter having a large power source and may not be effective to curtail shortrange communication, since generally such large jamming equipment would be far removed from the transmitters and receivers which are to be jammed.

In narrow band jamming one attempts to find the exact, or approximate, frequency at which the radio transmission occurs and to jam the transmission at that frequency. For such narrow band jamming one must first find the frequency upon which the transmitter is broadcasting and then tune the jamming radio transmitter to the same frequency and broadcast the noise. Such tuning may be performed manually by turning the dial of the radio receiver until it receives a broadcast, and then tuning the jamming radio transmitter to the same frequency. However, such manual tuning is slow and the transmitting party may be able to complete the message before the jamming broadcast is initiated. In addition, manual tuning depends upon the skill and diligence of personnel.

An alternative to manual narrow band tuning is a system which automatically detects the frequencies being utilized for transmission and automatically tunes a jamming radio transmitter at such frequency. Such automatic devices may operate rapidly and without the use of skilled personnel. However, such automatic devices may be relatively complex, large in size and consequently their placement may be far removed from the battlefield or other location where the transmission occurs. Such narrow band jamming is sometimes called "spot jamming" and may modulate an RF signal with a noise source at the selected frequency.

The jamming of radio transmission and reception is part of the electronic counter measures (ECM) in which the transmitter performing the radio jamming is part of an electronic counter measure system. The avoidance of such ECM radio jamming is obtained by electronic counter-counter measures (ECCM). One type of ECCM device is a "fast-frequency hopping radio" (FFH) utilized in the ultra high frequency range (UHF) or the very high frequency range (VHF). Such a fast-frequency hopping radio rapidly changes the frequency of its broadcasts, and almost simultaneously the frequency of reception by its receivers, in order to avoid a jamming noise signal which may be introduced on its original frequency. By the time the original frequency has been jammed, the fast-frequency hopping radio (FFH) has moved its transmission frequency to a new frequency.

A fast-frequency hopping radio transmission system (FFH) requires that the transmitter and receiver be in synchronism as to the changes in frequency. If the transmitter changes its frequency, to avoid jamming, and the receiver does not change its frequency at the same time to the new frequency, then the message will be lost.

One method of control over the frequency of the receiver by the transmitter, i.e., the selection of the new frequency by the transmitter acting as the master unit and the receiver acting as the slave unit, utilizes a coded message giving the new frequency information (the frequency to which the transmission will be hopped).

Another method of controlling both the transmitter and receiver hop frequencies is the use of identical pseudo random hopping pattern command circuits within both receiver and transmitter. The hopping pattern command circuits must be synchronized in time prior to transmission of a message. This is done by either a time-frequency search of a short, repeated hopping pattern which serves as a preamble, or some form of preset, time-of-day generation of a long hop pattern.

The problem of communications by radio in a battlefield situation may be complicated by other noise sources, in addition to jamming by enemy ECM transmitters. Such noise sources include radio transmission from friendly allied transmitters which arise from lack of coordination, as to frequencies, between various allied forces who may be operating in the same area and on the same frequency.

In addition to the ECCM measures that may be taken with the transmitter and receiver using waveform processing, such as fast frequency hopping radios (FFH) and frequency selective filters, it has also been suggested that the pattern of the receiver's antenna may be controlled to reduce jamming and other noise sources (antenna pattern adaptation). For example, if the location of the transmitter is known and fixed, then a directional high gain antenna may be directed towards the transmitter whose communication it is desired to be received. Even if the transmitter or receiver are moved, it is possible to utilize a highly directional antenna steered, either by hand or automatically, to favor radio reception from the desired transmitter and to reduce reception from jamming transmitters and other noise sources.

An alternative to the use of highly directional antennas is a null-forming antenna system which forms pattern nulls, i.e., non-receiving areas, in the direction of the interference. It has been shown that such antennas may produce a very large rejection of unwanted signals.

The directional ability of the antenna may be either determined by its physical structure or electrically. The physical structure includes its shape, the direction to which it is pointed, and its spacing. In addition, it is known that a directional effect may be obtained electrically using an array of antennas with the radiation pattern of the antenna array being varied, for example, by switching. In addition, the detected RF energy may be processed, i.e., wave form processing, without changing the antenna, so that the antenna array system detects signals from the transmitter whose emissions are desired to be detected and rejects interference by creating null patterns. One type of such RF wave form processing antenna system is called a steerable null antenna processor (SNAP). A typical SNAP system is shown in U.S. Pat. No. 4,298,873. The SNAP system determines the direction of interference and produces antenna nulls in those directions by processing the received RF signals. Such spacial discrimination in the detection of radio transmissions provides a reduction of the noise i.e., the unwanted RF energy to the input port of the receiver. In the SNAP system the control may be either manual or automatic and operates in the 30–80 MHz bandwidth. The SNAP system operates in an antenna pattern forming system using a number of antenna elements forming an antenna array and shifts the phase and adjusts the amplitudes of the RF output of each antenna element. For example, if the antenna array consists of two antenna elements (1 and 2) and the desired signal is S, the noise interference is I, then the SNAP system will attempt, by phase shifting and amplitude adjustment, to cause $I_1$ vector to cancel the $I_2$ vector and adds the two signal vectors $S_1$ and $S_2$. The pattern of the antenna is not fixed but rather is varied (steered) so that as each pattern is formed it is evaluated and adjusted to achieve maximum performance. For example, the patterns may be automatically changed on a heuristic basis by changing the vector multiplication until the best pattern (highest signal, least noise) is obtained.

OBJECTIVES AND FEATURES OF THE INVENTION

It is an objective of the present invention to provide a system of electronic counter-counter measures (ECCM) which will permit a radio receiver to obtain the desired communication from a transmitter and avoid interference caused by jamming and other noise sources.

It is a further objective of the present invention to provide such an ECCM system in which a steerable null antenna processor (SNAP), or other type of antenna pattern producing system, may be operated in a fully automatic mode, i.e., without an operator.

It is a further objective of the present invention to provide such a system which will be relatively immune to narrow band jamming and, in addition, provide broad band nulling of its antenna pattern so that it may receive over a wide frequency band (spread spectrum).

It is a still further objective of the present invention to provide such a system which utilizes fast frequency hopping (FFH) as a signal recognition method to distinguish the desired signals from jamming and other types of interference.

It is a still further objective of the present invention to provide such a system which will permit a wide band signal identification.

It is a still further objective of the present invention to provide such a system in which the antenna pattern has its null area, i.e., non-receptive area, directed only against wide band jamming, or other interference, and permitting the reception of narrow band interference, which, however, is relatively harmless due to the frequency hopping of the FFH receiver.

BRIEF DESCRIPTION OF THE DRAWINGS

Other objectives and features of the present invention will be apparent from the detailed description which follows, which provides the inventor's presently known best mode of practicing the invention and should be considered in conjunction with the accompanying drawings.

In the drawings.

DETAILED DESCRIPTION OF THE INVENTION

Figure 1:
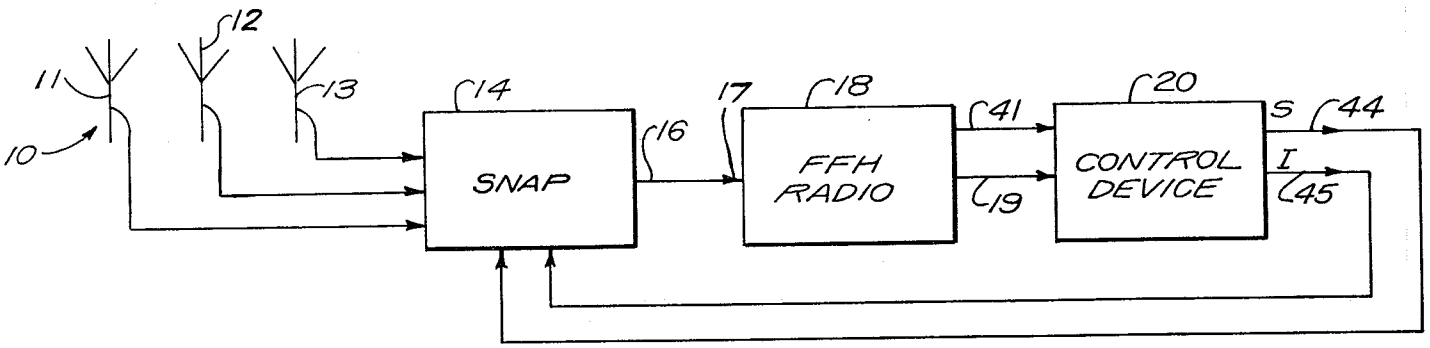
FIG. 1 is a block diagram of the system of the present invention.
Figure 2:
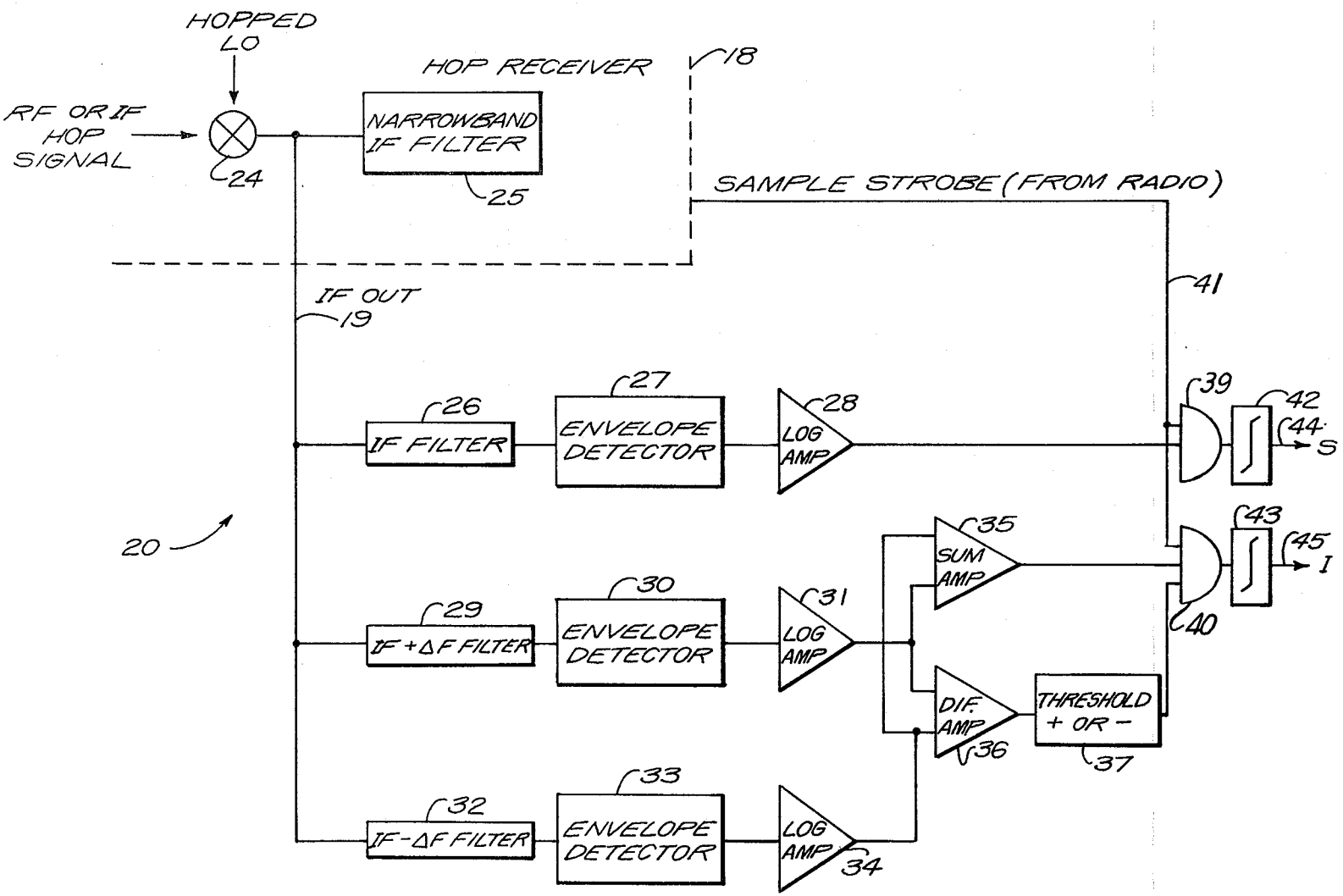
FIG. 2 is a block diagram of the circuit of the automatic control device of the present invention.

The automatic control device shown in the block diagram of FIG. 2 is intended to be connected as part of the overall system shown in FIG. 1.

As shown in FIG. 1, the antenna system 10 is an antenna array consisting of a plurality of antenna elements 11, 12 and 13. Each of the antenna elements may be a small short antenna which is positioned within one wavelength of its neighboring antenna element. The elements of the antenna array 11, 12 and 13 are individually electrically connected to the steerable null antenna processor (SNAP) 14. The SNAP system 14 receives the RF power from each of the antenna elements and electrically processes the RF power to provide, in effect, an antenna array which is directed towards the transmitter of the desired signals and which provide a null in the direction of the jamming or other interference.

The SNAP system 14 obtains such an effective pattern by processing and combining the RF power from each of the elements of the antenna array. This processing includes the cancellation of the vectors of the interference by combining those vectors from the different elements 11–13 of the array and strengthening of the desired signal by the summing of the signal from each of the elements. The SNAP system accomplishes such signal processing by phase shifting and amplitude adjustment, with both phase shifting and amplitude adjustment being under the control of the SNAP. The signal produced at the output port 16 of the SNAP consequently is a signal in which the interference has been minimized and the desired signal has been maximized. In other words, the signal processing by the SNAP 14 provides a signal having a large signal-to-interference ratio at the output port 16.

The signal processing of the SNAP system 14 is continuously under automatic review and change as the jamming changes in direction or frequency and as the transmitter or receivers change location. The output port 16 of the SNAP device is connected to the input port 17 of the fast frequency hopping radio receiver 18 (FFH).

Generally, antenna pattern producing systems, such as the SNAP system, are automatic strong signal suppressors which must be monitored by a radio operator to avoid suppression of desired signals. Unless some reliable automatic means is provided to distinguish a desired signal from a jamming signal, a SNAP cannot be operated in a fully automatic mode. If a simple identifying preamble code is used as the transmitted signal to obtain a new hop frequency, it can be easily duplicated by an enemy. If a more complex code is used, signal identification may require too much time before the message is transmitted. The narrow band nature of the VHF signal inherently prevents transmission of a rapid yet complex identification preamble. However, when a SNAP operates in conjunction with a spread spectrum radio, such as a fast frequency hopping radio (FFH), it is possible to obtain the effect of a rapid and reliable signal identification preamble. Spread spectrum signal acquisition is the ideal means of controlling the strong signal suppression of the SNAP. However, there are certain unique problems in designing a SNAP to work with a spread spectrum system. The antenna null formed by the SNAP system 14 is broad band and effective over the wide frequency band covered by the spread spectrum of the fast frequency hopping (FFH) radio with which it is associated, i.e., it must be effective over the full range of hop frequencies. However, the SNAP system may obtain such wide band nulling using delay-type phase shifters.

Receiver 18 is a fast frequency hopping radio that changes its narrow band receiving frequency in precise time synchronism with its desired signal transmitter, hopping over a wide frequency band (spread spectrum). Frequency of both transmitter and receiver are controlled by identical, time-synchronized pseudo random hop pattern generators. The IF (intermediate frequency) port 19 of the fast frequency hopping radio receiver 18 is connected to the control device 20 of the present invention.

The control device 20 provides, at its two output ports 44 and 45, the signal level and the interference level respectively. Operation of the SNAP with a frequency hopping system requires special control provisions which are provided by the control device 20. Because the fast frequency hopping receiver 18 is relatively immune to narrow band jammers, the control device 20 ignores narrow band signals and concentrates on broad band interference. The control device 20, an antenna null processor, used with a frequency hopping radio: (i) provides broad band nulling; (ii) uses hop signal recognition to distinguish desired signals from interference signals; and (iii) uses its null only against wideband interference, while ignoring relatively harmless narrow band signals.

The detailed circuit diagram for the control device 20 of the present invention is shown in FIG. 2 in block diagram. As shown in FIG. 2, the fast frequency hopping receiver 18 includes narrow band IF filter 25 which is connected to a mixer 24 having both the RF (or IF) hopping signal and the hopped LO (local oscillator signal). At the output of the mixer 24 the receiver signal is down-converted using a hopped local oscillator signal. The difference output created by mixing a hopped received signal and an identically hopped LO signal is a fixed IF frequency, part of which IF signal energy is transmitted to the input port 19.

The control device 20 includes a bank of three filters which receive the tapped IF signal. It includes one filter which is at the IF frequency of the receiver and two filters which are offset by $\pm\Delta F$ from the IF frequency. The input port 19 of the control device 20 is connected to receive part of the IF signal energy (tapped IF signal) and transmit it to a set of parallel IF filters. The first IF filter 26, set at the IF frequency (IF) of the receiver, is connected to an envelope detector 27 which in turn is connected to a log amplifier 28. Similarly, the IF-plus change in frequency ($IF+\Delta F$) filter 29 is connected to envelope detector 30 which in turn is connected to a log amplifier 31. Similarly, the IF-minus change in frequency ($IF-\Delta F$) filter 32 is connected to the log amplifier 34. The log amplifiers 31 and 34 are connected to respectively the sum amplifier 35 and the differential amplifier 36. The differential amplifier 36 in turn is connected to plus or minus threshold unit 37. The log amplifier 28 is connected to the "AND" gate 39. The summing amplifier 35 and the threshold unit 37 are connected to the "AND" gate 40.

The timing for the gates 39 and 40 is from a sample strobe on line 41, which is obtained from the receiver radio 18. Gates 39 and 40 are respectively connected to the summing units 42 and 43 whose output ports, respectively 44 and 45, provide the signal level at output port 44 and the intereference level at output port 45.

As the receiver 18 hops around the band, providing different IF signals, the filter 26, set to the receiver IF, provides samples of actual received hopping signal energy. The offset filters 29,32 provide samples of energy in the vicinity of the hop frequency (plus and minus) but not at that frequency. As the receiver 18 hops, the offset frequency energy samples are pseudorandomly taken over the full hopping band. The hopping action of the receiver 18 is used to sample interference uniformly over the full hopping range of the receiver, while also monitoring any desired hop signal energy. The sampling ignores large narrowband signals because of the two offset filters 29,32. The outputs of the two filters 29,32 are compared in the threshold device 37 for example (beyond threshold) RF level differences. If the difference is greater than some set limit ($\pm$ threshold) this indicates that one of the filter has hit upon a large narrowband signal. The interference measurement should not be influenced by isolated narrowband signals, so that particular sample is discarded by the non-operation of the threshold device 37 on the AND gate 40. Alternatively, and not shown, more than two offset filters may be used, in which case any filter which receives much greater energy than the others can be assumed to have received a large narrowband signal. That one filter input is discarded, and the others are added to form an energy sample.

An interference level ("I" level) is formed from the added outputs of the offset filters at output port 45. The I level is available at port 45 for comparison with the "S" level (desired signal level) output which is received by the IF filter and whose output is at port 44. A low S/I level indicates that either no desired signal is present or a high level of interference is present along with the desired signal. In either case, the SNAP is controlled by control device 20 to minimize the "I" term. If a high S/I level is received (high enough to permit desired signal detection) the SNAP can be directed to maximize "S" with respect to "I".

The SNAP system 14 will change its effective antenna pattern until the desired high S/I ratio is obtained. For example, the change in antenna pattern may be on a programmed or random basis until a preselected S/I ratio is obtained, at which point the SNAP system ceases to change the antenna pattern.

What is claimed is:

1. A radio receiving system for use in an electronic counter-counter measure (ECCM) system to overcome jamming and other interference (I), in which ECCM system a radio transmitter broadcasts signals (S) on a narrow selected frequency which is rapidly changed to provide fast frequency hopping (FFH), the ECCM receiving system comprising:

an antenna system which receives over the broadband spread spectrum of radio frequencies of the transmitter, a steerable null antenna processor means connected to said antenna system to create an effective antenna null pattern with the null in the direction of broadband interference, a fast frequency hopping (FFH) radio receiver means connected to said antenna processor means to avoid narrowband jamming by rapidly changing its narrow receiving frequency in synchronism with the corresponding frequency changes at the transmitter, said FFH radio means producing an intermediate frequency (IF) containing the signal (S) and interference (I); and a control device connected to said (FFH) radio receiver means, said control device having a first and second output port connected to said antenna processor means and having at least three narrowband IF filter means for receiving a portion of the intermediate frequency (IF), the first of said IF filter means being connected to a first summing means to provide the signal (S) level at said first output port and the second and third of said IF filter means, each differently offset from the IF frequency, being connected to a second summing means to produce the interference (I) level at said second output port.

2. A radio system as in claim 1 wherein said second and third IF filter means are offset from said IF frequency by respectively the plus and minus of a change in the IF frequency.

3. A radio system as in claim 1 wherein the antenna system is an antenna array comprising a plurality of antenna elements.

4. A radio system as in claim 1 wherein said second summing means of said control device further includes threshold means for determining the signal level difference between said second IF filter means and said third IF filter means and preventing signals above a certain threshold level from passing to said second output port.

5. A radio system as in claim 1 and further including a threshold plus or minus means which provides an output when the difference between the offset filters is respectively greater or less than a predetermined threshold.

6. A radio receiving system for use in an electronic counter-counter measure (ECCM) system to overcome jamming and other interference (I), in which ECCM system a radio transmitter broadcasts signals (S) on a narrow selected frequency which is rapidly changed to provide fast frequency hopping (FFH); the ECCM system comprising:

an antenna system which receives over the broadband spread spectrum of radio frequencies of the transmitter;

a steerable null antenna processor means connected to said antenna system to create an effective antenna null pattern with the null in the direction of broadband interference, said pattern being determined by a comparison of signal level (S) to interference level (I), a fast frequency hopping (FFH) radio receiver means connected to said antenna processor means to avoid narrowband jamming by rapidly changing its narrow receiving frequency in synchronism with the corresponding frequency changes at the transmitter, said FFH radio means producing an intermediate frequency (IF) containing the signal (S) and interference (I); and a control device connected to the (FFH) radio receiver means, said control device having a first and second output port connected to said antenna processor means and having at least three narrowband IF filter means for receiving a portion of the intermediate frequency (IF); the first of said IF filter means being connected to a first summing means to provide the signal (S) level at said first output port and the second and third of said IF filter means, each differently offset from the IF frequency, connected to a second summing means to produce the interference (I) level at said second output port;

said first and second output ports of said control device being connected to said antenna processor means to provide said signal (S) and interference (I) levels to said antenna processor means.

7. A radio system as in claim 6 wherein said second and third IF filter means are offset from said IF frequency by respectively the plus and minus of a change in the IF frequency.

8. A radio system as in claim 6 wherein the antenna system is an antenna array comprising a plurality of antenna elements.

9. A radio system as in claim 6 wherein said second summing means of said control device further includes threshold means for determining the signal level difference between said second IF filter means and said third IF filter means and preventing signals above a certain threshold level from passing to said second output port.

10. A radio system as in claim 6 and further including a threshold plus or minus means which provides an output when the difference between the offset filters is respectively greater or less than a predetermined threshold.

* * * * *